US009577374B1

(12) United States Patent
Grant et al.

(10) Patent No.: US 9,577,374 B1
(45) Date of Patent: Feb. 21, 2017

(54) TEXTILE CONNECTOR FOR AN ELECTRONIC TEXTILE HAVING A SNAP FASTENER WITH CONTACTS

(71) Applicant: TYCO ELECTRONICS CORPORATION, Berwyn, PA (US)

(72) Inventors: Megan Grant, San Francisco, CA (US); Danny Hon Bun Chan, Fremont, CA (US); Patricia Hayes-Danitz, Menlo Park, CA (US)

(73) Assignee: TE Connectivity Corporation, Berwyn, PA (US)

( * ) Notice: Subject to any disclaimer, the term of this patent is extended or adjusted under 35 U.S.C. 154(b) by 0 days.

(21) Appl. No.: 14/921,704

(22) Filed: Oct. 23, 2015

(51) Int. Cl.

| | |
|---|---|
| ***H01R 33/00*** | (2006.01) |
| ***H01R 13/627*** | (2006.01) |
| ***H01R 13/22*** | (2006.01) |
| ***H01R 4/58*** | (2006.01) |

(52) U.S. Cl.
CPC ..... *H01R 13/6278* (2013.01); *H01R 4/58* (2013.01); *H01R 13/22* (2013.01)

(58) Field of Classification Search
CPC ..... H01R 13/24; H01R 4/58; H01R 4/64
USPC ..... 439/37, 69, 82; 361/760, 761, 767
See application file for complete search history.

(56) References Cited

U.S. PATENT DOCUMENTS

| | | | | |
|---|---|---|---|---|
| 6,319,015 | B1 * | 11/2001 | Faunce | H01R 11/22 24/662 |
| 6,350,129 | B1 * | 2/2002 | Gorlick | H01R 4/48 439/37 |
| 7,186,931 | B2 * | 3/2007 | Chang | A44B 1/24 200/43.11 |
| 7,210,939 | B2 * | 5/2007 | Marmaropou | A41D 1/005 2/69 |
| 8,259,460 | B2 * | 9/2012 | Bhattacharya | H05K 3/301 174/260 |
| 8,376,759 | B2 * | 2/2013 | Debock | H01R 12/775 439/37 |
| 2007/0026695 | A1 * | 2/2007 | Lee | H01R 12/592 439/37 |
| 2015/0201856 | A1 * | 7/2015 | Stork | A61B 5/04085 600/384 |

* cited by examiner

*Primary Examiner* — Chandrika Prasad

(57) ABSTRACT

A textile connector for an electronic textile includes a snap fastener having first and second snap segments configured to be snap fastened together such that the electronic textile is mechanically secured therebetween. A first contact is held by the snap fastener. The first contact is configured to be electrically connected to a first conductor of the electronic textile to define a first signal line. A second contact is held by the snap fastener. The second contact is configured to be electrically connected to a second conductor of the electronic textile to define a second signal line. The first and second signal lines transmit different data signals from the electronic textile to an electronic component mounted to the electronic textile.

20 Claims, 3 Drawing Sheets

TEXTILE CONNECTOR FOR AN ELECTRONIC TEXTILE HAVING A SNAP FASTENER WITH CONTACTS

BACKGROUND OF THE INVENTION

The subject matter herein relates generally to textile connectors for an electronic textile.

Electronic textiles are known and used as wearable technology, such as intelligent clothing or smart clothing, which allows for the incorporation of built-in technological elements in textiles and/or clothes. Electronic textiles may be used in many different applications, including sports training data acquisition, for health monitoring of persons or patients, for first responder (e.g. fire and police) or soldier worn electronics systems, and the like. Electronic textiles are typically fabrics that enable monitoring, computing, digital components and electronics to be embedded in or worn on the textiles. Electronic textiles typically have conductors and electronic devices embedded in or provided on the garments. Some electronic textiles have electronic functions incorporated directly on the textile fibers.

Known electronic textiles are not without disadvantages. For example, attaching or terminating electronic components to the embedded conductors is difficult to accomplish. For example, because the textile material is movable and stretchable, the conductors move and stretch with the material. Reliable electrical connection to such conductors is difficult. Additionally, many conventional electronic textiles incorporate multiple conductors that need to be independently terminated to corresponding electronic devices. Each conductor has a separate connector, leading to increased part count and increased assembly time.

BRIEF SUMMARY OF THE INVENTION

In one embodiment, a textile connector for an electronic textile includes a snap fastener having first and second snap segments configured to be snap fastened together such that the electronic textile is mechanically secured therebetween. A first contact is held by the snap fastener. The first contact is configured to be electrically connected to a first conductor of the electronic textile to define a first signal line. A second contact is held by the snap fastener. The second contact is configured to be electrically connected to a second conductor of the electronic textile to define a second signal line. The first and second signal lines transmit different data signals from the electronic textile to an electronic component mounted to the electronic textile.

In another embodiment, a textile connector is provided including a snap fastener having first and second snap segments each having a connecting segment and a flange surrounding the connecting segment. The connecting segments are configured to be snap fastened together with an electronic textile mechanically secured between the flanges of the first and second snap segments. The first snap segment has a first groove and a second groove. The flange of the first snap segment surrounds the first and second grooves being dielectric. The textile connector includes a first contact received in the first groove. The first contact is configured to be electrically connected to a first conductor of the electronic textile to define a first signal line. The textile connector includes a second contact received in the second groove and electrically isolated from the first contact by the dielectric flange of the first snap segment. The second contact is configured to be electrically connected to a second conductor of the electronic textile to define a second signal line. The first and second signal lines transmit different data signals from the electronic textile to an electronic component mounted to the electronic textile.

In a further embodiment, a wearable electronic assembly is provided including an electronic textile having textile material and first and second conductors interspersed with the textile material and at least one electronic component mounted to the electronic textile. A wearable textile connector electrically connects the first and second conductors and the electronic connector. The textile connector includes a snap fastener having first and second snap segments configured to be snap fastened together such that the electronic textile is mechanically secured therebetween. The textile connector includes a first contact held by the snap fastener. The first contact is configured to be electrically connected to the first conductor of the electronic textile to define a first signal line. The textile connector includes a second contact held by the snap fastener. The second contact is configured to be electrically connected to the second conductor of the electronic textile to define a second signal line. The first and second signal lines transmit different data signals from the electronic textile to an electronic component mounted to the electronic textile.

DETAILED DESCRIPTION OF SPECIFIC EMBODIMENTS OF THE INVENTION

Figure 1:
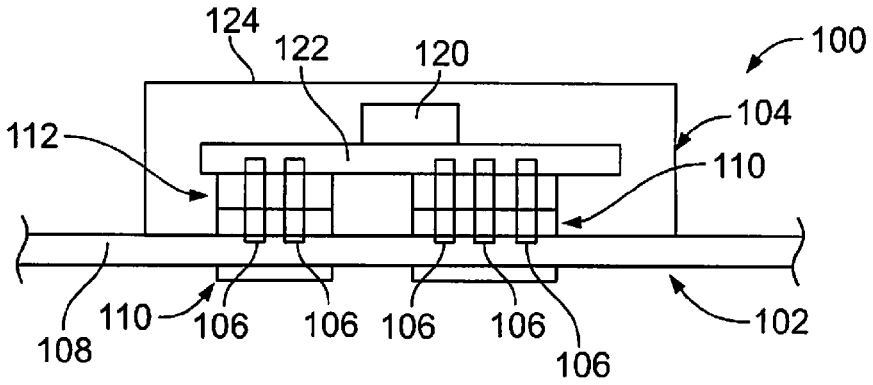
FIG. 1 is a schematic illustration of a wearable electronic assembly having textile and mating connectors formed in accordance with an exemplary embodiment.

FIG. 1 is a schematic illustration of a wearable electronic assembly 100 formed in accordance with an exemplary embodiment. The wearable electronic assembly 100 includes an electronic textile 102 and an electronic component 104 mounted to the electronic textile 102. The electronic textile 102 may define a garment, clothing, a shoe, a band, or other wearable technology.

The electronic textile 102 includes a plurality of conductors 106 interspersed with textile material 108 of the electronic textile 102. The conductors 106 are integrated with the textile material 108 such that the electronic textile 102 is a unitary, wearable textile. For example, the conductors 106 may be flexible circuits or copper threads woven with the textile material 108. Alternatively, the conductors 106 may be printed on the textile material 108. Other types of conductors 106 may be provided within the electronic textile 102.

The conductors 106 may be used as passive electronics, such as conductors or resistors, for data acquisition from the wearer. For example, the wearable electronic assembly 100 may be used for sports training data acquisition or for health monitoring of the wearer. The conductors 106 may be used to monitor vital signs of the wearer such as heart rate, respiration rate, temperature, activity, posture, or other vital signs. The data gathered by monitoring the vital signs of the wearer by the conductors 106 may be transmitted to the electronic component 104, such as for further processing, analysis, or transmission to another system. The conductors 106 may be routed to various locations on the electronic textile 102. For example, for monitoring the wearer's vital signs, the conductors 106 may be routed to various locations around the wearer's chest or to other areas where vital signs are monitored.

In other embodiments, the conductors 106 may define active components, such as transistors, diodes, solar cells, or other types of components, which may be electrically connected to the electronic component 104. In other various embodiments, the conductors 106 may be used to connect the electronic component 104 with other electronic components, such as sensors, displays, light emitting diodes, fiber networks, or other computing devices which may be worn by the wearer or carried by the wearer, such as on the electronic textile 102 or in another component, such as a backpack.

Optionally, the conductors 106 may be embedded within the textile material 108. The conductors 106 may be provided on and exposed on one or more surfaces of the textile material 108. For example, when woven with the textile material 108, the conductors 106 may be provided on both top and bottom surfaces of the textile material 108, and pass through the textile material, as the conductors 106 are weaved with the textile material 108. In other embodiments, the conductors 106 may be printed on the top surface and/or the bottom surface and/or on other intermediary layers of the textile material 108.

The conductors 106 are electrically connected to the electronic component 104 by wearable textile connectors 110. In an exemplary embodiment, each textile connector 110 is electrically connected to a plurality of conductors 106 such that each textile connector 110 defines multiple signal lines or channels for transmitting different data signals between the electronic component 104 and the corresponding conductors 106. As such, multiple conductors 106 are connected to the electronic component 104 through the same multi-channel textile connector 110. Optionally, the conductors 106 may be electrically connected to different electronic components 104 by corresponding textile connectors 110. However, in the illustrated embodiment, a single electronic component 104 is provided and the conductors 106 are routed to a common location or area on the electronic textile 102 such that the textile connectors 110 provide a direct connection between the electronic component 104 and the corresponding conductors 106. For either embodiment, the electronic component(s) 104 may be smaller (e.g., have a smaller component footprint) as multiple signal lines are provided by the multi-channel textile connector(s) 110. Additionally, connection or assembly time may be reduced as fewer textile connectors 110 are connected to the electronic component(s) 104.

In an exemplary embodiment, the electronic component 104 includes a control module 120 electrically connected to the conductors 106. The control module 120 may include a microprocessor that processes data or signals from the conductors 106. The control module 120 may include a memory for storing the data from the conductors 106. The control module 120 may include a communication device, such as a transmitter/receiver, for transmitting data to or from the electronic component 104. The control module 120 may output data or signals to the conductors 106, which may be transmitted along the conductors 106 to another electronic component. In such embodiments, a battery or other power source may also be provided.

In an exemplary embodiment, the control module 120 is mounted to a circuit board 122. The circuit board 122 may be a rigid circuit board or may be a flexible circuit board. The circuit board 122 is electrically connected to the textile connectors 110. For example, the wearable electronic assembly 100 may include one or more mating connectors 112 coupled to the circuit board 122. The mating connectors 112 are mated with corresponding textile connectors 110 to electrically connect the textile connectors 110 to the circuit board 122, such as to conductors 126 of the circuit board 122. The mating connectors 112 and the textile connectors 110 may have any type of mating interface for creating a mechanical and electrical connection therebetween. Optionally, the mating connectors 112 and the textile connectors 110 may be snap fastened together. For example, the mating connectors 112 and the textile connectors 110 may be press mated to create the mechanical and electrical connection therebetween. Optionally, the mating and textile connectors 112, 110 may have corresponding, complementary connecting segments, which are used to mechanically secure the textile connectors 110 to the mating connectors 112. For example, either of the connectors 110, 112 may have a male snap and the other of the connectors 110, 112 may have a female snap that are capable of being snap fastened together. The connectors 110, 112 may be mated by processes or features other than snap fasteners in alternative embodiments.

Once mechanically secured, the multiple signal lines of the textile connector 110 are electrically connected to corresponding multiple signal lines of the mating connector 112. The connectors 110, 112 may have conductors with separable mating interfaces. Optionally, such conductors may be biased against each other to ensure a reliable electrical connection is maintained between such conductors. Such biasing may occur, at least in part, from the snap fastening of the connectors 110, 112. The biasing may occur from internal biasing from one or both of the conductors, such as from spring beams, pogo-pins, or other components of the conductors themselves.

In an exemplary embodiment, the electronic component 104 includes a housing 124 surrounding the control module 120 and the circuit board 122. The housing 124 may be mounted to the electronic textile 102 using any type of known securing means such as clips, fasteners, adhesives, hook and loop fasteners, thread, and the like. Optionally, the housing 124 may be removably mounted to the electronic textile 102 such that the electronic component 104 may be removed from the electronic textile 102, such as for washing the electronic textile 102. Alternatively, the housing 124 may be permanently mounted and sealed to the electronic textile 102. As such, the electronic component 104 is intended to remain on the electronic textile 102 before, during, and after use of the electronic textile 102.

Figure 3:
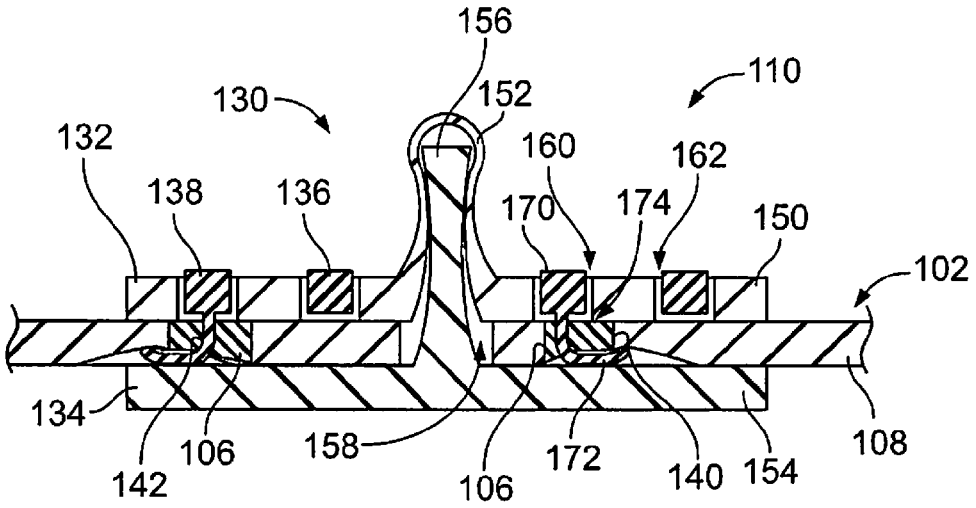
FIG. 3 is a side view of the textile connector mounted to an electronic textile.
Figure 2:
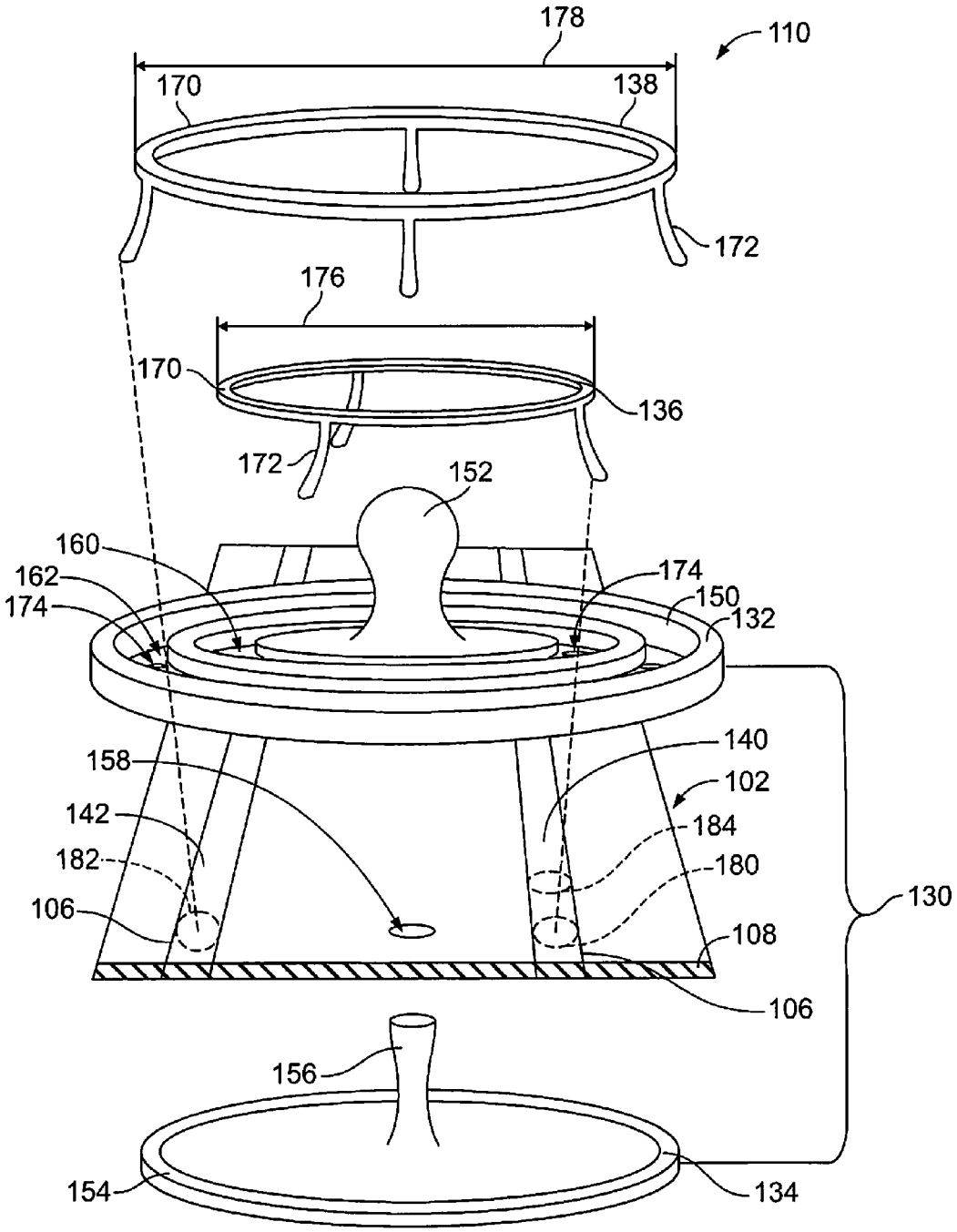
FIG. 2 is an exploded view of an exemplary embodiment of the textile connector.

FIG. 2 is an exploded view of the textile connector 110 in accordance with an exemplary embodiment. FIG. 3 is a side view of the textile connector 110 mounted to the electronic textile 102. The textile connector 110 includes a snap fastener 130 having first and second snap segments 132, 134 capable of being snap fastened together such that the electronic textile 102 is mechanically secured therebetween.

First and second contacts 136, 138 are held by the snap fastener 130. For example, in the illustrated embodiment, the first and second contacts 136, 138 are held by the first snap segment 132; however, either or both of the contacts 136, 138 may be held by the second snap segment 134. Additionally, in alternative embodiments, the snap fastener 130 may hold more than two contacts for defining additional signal channels for the textile connector 110.

The first contact 136 is configured to be electrically connected to one of the conductors 106, referred to hereinafter as a first conductor 140, of the electronic textile 102 to define a first signal line in the textile connector 110. The second contact 138 is configured to be electrically connected to another of the conductors 106, referred to hereinafter as a second conductor 142, of the electronic textile 102 to define a second signal line of the textile connector 110. The electronic textile 102 may include any number of conductors 106 and is not limited to the first and second conductors 140, 142. Such additional conductors 106 may be electrically connected to other textile connectors 110, or alternatively, the textile connector 110 may be electrically connected to additional conductors 106 in addition to the first and second conductors 140, 142.

As seen in FIG. 1, the first and second signal lines, defined by the first and second contacts 136, 138, transmit different data signals from the electronic textile 102 to the electronic component 104 via the mating connector 112. For example, the first and second contacts 136, 138 may be electrically connected to different mating contacts of the mating connector 112 to form the signal lines from the first and second conductors 140, 142 to the electronic component 104.

The first snap segment 132 includes a flange 150 and a connecting segment 152 used to connect the first snap segment 132 to the second snap segment 134. In the illustrated embodiment, the connecting segment 152 is a stud configured for snap fastening to the mating connector 112. For example, the connecting segment 152 is a male part configured to be received in a female part of the mating connector 112. Other types of connecting arrangements may be provided in alternative embodiments. In an exemplary embodiment, the connecting segment 152 is also used to connect the first snap segment 132 to the second snap segment 134.

The second snap segment 134 includes a flange 154 and a connecting segment 156. The connecting segment 156 of the second snap segment 134 is mechanically connected to the connecting segment 152 of the first snap segment 132. In the illustrated embodiment, the connecting segment 156 is a post or eyelet configured to be received in the connecting segment 152. For example, the connecting segment 156 may pass through an opening 158 in the textile material 108 of the electronic textile 102. The connecting segment 156 is plugged into the connecting segment 152. Other types of connecting arrangements may be provided in alternative embodiments. The connecting segment 156 may be sized and shaped to mechanically secure to the connecting segment 152. For example, the connecting segment 156 may be pressed into the connecting segment 152. The connecting segment 156 may be deformed when received into the connecting segment 152 to lock the second snap segment 134 to the first snap segment 132. When the first and snap segments are connected together, the electronic textile 102 is positioned between the flanges 150, 154. The snap fastener 130 may be tightly held on the electronic textile 102 when the snap segments 132, 134 are coupled together. Optionally, the textile material 108 may be at least partially compressed between the snap segments 132, 134.

In an exemplary embodiment, the flange 150 includes a first groove 160 and a second groove 162 extending circumferentially around the connecting segment 152. The first groove 160 receives the first contact 136 and the second groove 162 receives the second contact 138. Additional grooves may be provided in the flange 150 to hold additional contacts in various embodiments. The grooves 160, 162 hold the relative positions of the contacts 136, 138. The contacts 136, 138 may be held by the snap fastener 130 by mechanisms other than grooves in alternative embodiments.

In an exemplary embodiment, the first snap segment 132 is manufactured from a dielectric material such that the contacts 136, 138 are electrically isolated from each other by the dielectric material of the first snap segment 132. Optionally, the second snap segment 134 may be manufactured from a dielectric material similar to the dielectric material of the first snap segment 132. For example, the snap segments 132, 134 may be manufactured from a plastic material. Optionally, the second snap segment 134 may include grooves or slots configured to receive portions of the contacts 136, 138. In other various embodiments, the second snap segment 134 may include the grooves 160, 162 used to hold the first and second contacts 136, 138.

In an exemplary embodiment, the first and second contacts 136, 138 are ring shaped. The first and second contacts 136, 138 may include similar components and like components may be identified with like references numerals. The description below focuses the first contact 136, and the second contact 138 may include similar features.

The first contact 136 includes a main body 170. In the illustrated embodiment, the main body 170 is ring shaped and may be referred to herein after as a ring 170. In alternative embodiments, the main body 170 and corresponding grooves may be other shapes, such as rectangular, oblong, asymmetrical, and the like. The ring 170 of the first contact 136 has a first diameter 176 while the ring 170 of the second contact 138 has a second diameter 178 larger than the first diameter 176. The ring 170 of the first contact 136 thus defines an inner ring and the ring 170 of the second contact 138 thus defines an outer ring, which concentrically surrounds the inner ring of the first contact 136.

The first contact 136 includes one or more projections 172 that extend from the main body 170. The projections 172 may be prongs or claws that may pierce the textile material 108 and/or the conductors 106 to mechanically and electrically connect the first contact 136 to such conductor 106. The projections 172 may grip or engage the textile material 108. For example, the projections 172 may be folded or curled under the textile material 108 when the textile connector 110 is assembled. The projections 172 may be folded over in a similar manner as a staple to grip and secure the first contact 136 to the electronic textile 102. Any number of projections 172 may extend from the main body 170. Optionally, the projections 172 may be spaced equally around the main body 170. Optionally, the first and second contacts 136, 138 may include a different number of projections 172. In an exemplary embodiment, the first and second contacts 136, 138 are oriented relative to the first snap segment 132 such that projections are offset or not aligned such that the projections 172 do not engage each other, which would electrically short the signal lines.

During assembly, the contacts 136, 138 are loaded into the grooves 160, 162. Optionally, the first snap segment 132 may include openings 174 through the flange 150 that receive the projections 172. Alternatively, the projections 172 may pierce the first snap segment 132 to pass through the first snap segment 132. When the contacts 136, 138 are received in the grooves 160, 162, the projections 172 extend beyond the flange 150 (e.g. below the flange 150) for connection to the electronic textile 102. The snap fastener 130 is position relative to the conductors 140, 142 such that at least one projection 172 of each contact 136, 138 engages the corresponding conductor 140, 142 to create an electrical connection therebetween.

The first contact 136 overlaps the first conductor 140 at a first overlap region 180. The second contact 138 overlaps the second conductor 142 at a second overlap region 182. The snap fastener 130 is oriented such that the projections 172 of the contacts 136, 138 are aligned with the overlap regions 180, 182. As the first snap segment 132 is coupled to the electronic textile 102, the projections 172 pierce the textile material 108 at or near the corresponding conductors 140, 142. The projections 172 may directly pierce the conductors 140, 142. Alternatively, the projections 172 may pierce the textile material 108 near the conductor 140, 142 and the projections 172 may be bent or folded in such a manner that the projections 172 engage and are electrically connected to the conductors 140, 142. As such, the first contact 136 is electrically connected to the first conductor 140 at the first overlap region 180 and the second contact 138 is electrically connected to the second conductor 142 at the second overlap region 182. The length of projections 172 may be chosen to avoid unintended or undesired electrical contact with other conductors in textile material 108.

Optionally, due to the concentric nature of the contacts 136, 138, the first contact 136 may overlap a portion of the second conductor 142 and/or the second contact 138 may overlap a portion of the first conductor 140. For example, in the illustrated embodiment, the second contact 138 overlaps the first conductor 140 at a third overlap region 184. The second contact 138 is electrically isolated from the first conductor 140 at the third overlap region 184 by the dielectric material of the first snap segment 132. As such, the second contact 138 is not electrically connected to the first conductor 140.

In an exemplary embodiment, the projections 172 are folded or bent around the textile material 108 and thus grip or are secured to the electronic textile 102. The flange 154 of the second snap segment 134 is positioned below the projections 172 such that the projections 172 are sandwiched between the flanges 150, 154. The flange 154 of the second snap segment 134 may press against the projection 172 when the second snap segment 134 is coupled to the first snap segment 132. Such pressure may force the projection 172 to maintain a reliable electrical connection with the corresponding conductor 140, 142. In other alternative embodiments, the projections 172 may pass through the textile material 108 and create an electrical connection with the corresponding conductors 140, 142, and may also pass through the flange 154 of the second snap segment 134. Such projections 172 may be folded or bent below the flange 154 of the second snap segment 134, which may help mechanically secure the second snap segment 134 to the first snap segment 132. Optionally, a portion of the second snap segment 134 may cover such projections 172 to reduce the risk of snagging or electrically shorting. For example, the second snap segment 134 may include pockets or grooves that receive the projections 172 on the bottom side of the flange 154.

Figure 5:
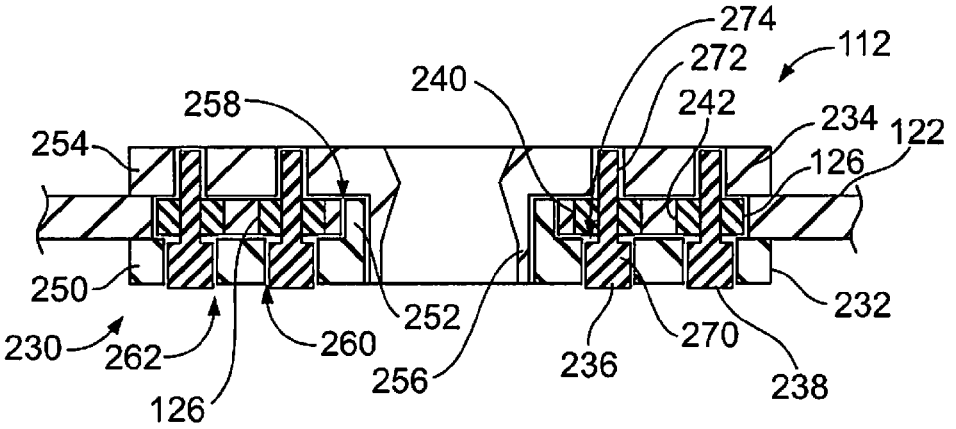
FIG. 5 is a side view of the mating connector mounted to a circuit board.
Figure 4:
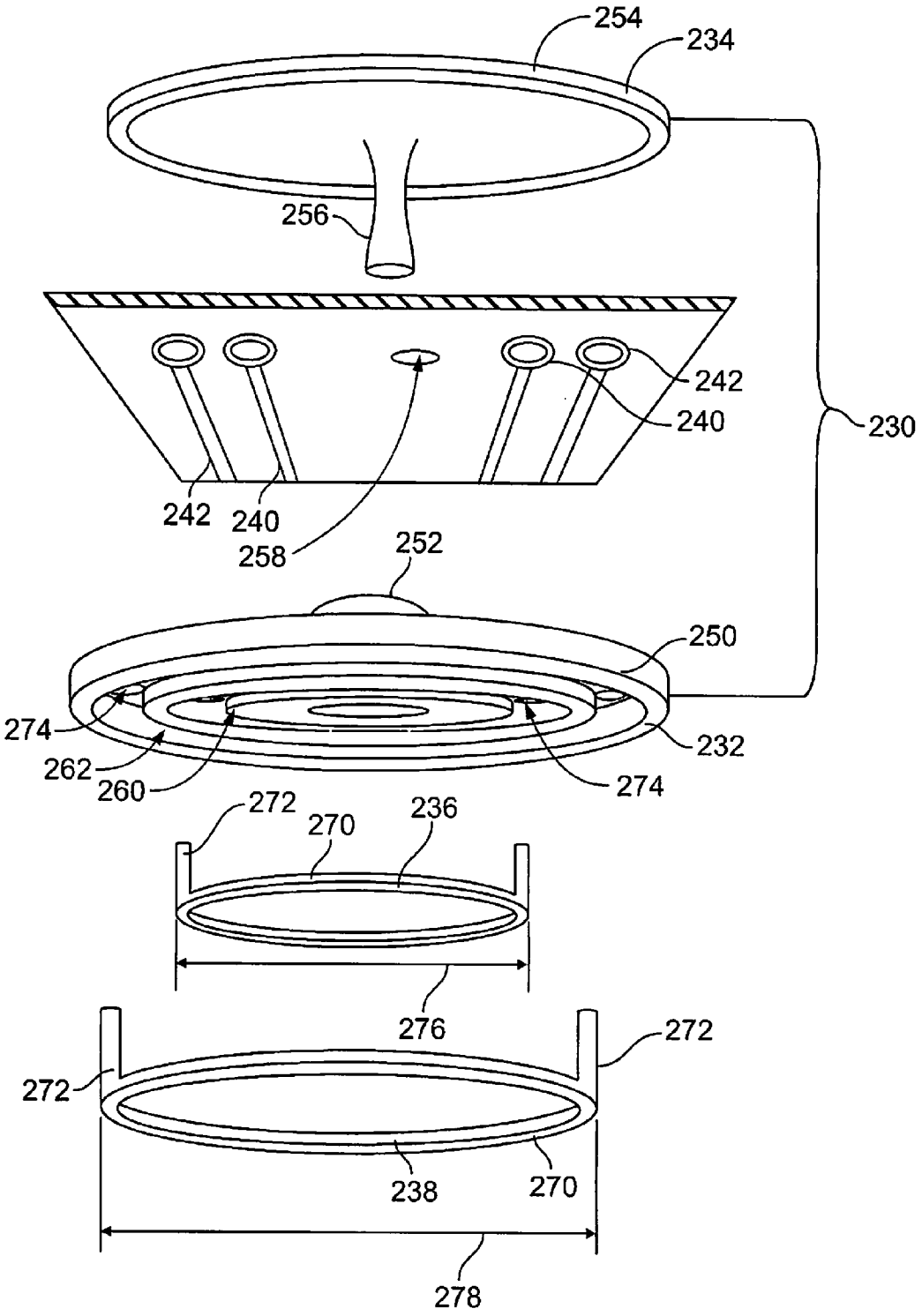
FIG. 4 is an exploded view of an exemplary embodiment of the mating connector.

FIG. 4 is an exploded view of the mating connector 112 in accordance with an exemplary embodiment. FIG. 5 is a side view of the mating connector 112 mounted to the circuit board 122. The mating connector 112 includes a snap fastener 230 having first and second snap segments 232, 234 capable of being snap fastened together such that the circuit board 122 is mechanically secured therebetween.

First and second contacts 236, 238 are held by the snap fastener 230. For example, in the illustrated embodiment, the first and second contacts 236, 238 are held by the first snap segment 232; however, either or both of the contacts 236, 238 may be held by the second snap segment 234. Additionally, in alternative embodiments, the snap fastener 230 may hold more than two contacts for defining additional signal channels for the mating connector 112. The contacts 236, 238 are configured to be electrically connected to the contacts 136, 138, respectively, when the mating connector 112 is mated with the textile connector 110 as shown in FIG. 2.

The first contact 236 is configured to be electrically connected to one of the conductors 126, which may be referred to hereinafter as a first conductor 240, of the circuit board 122 to define a first signal line in the mating connector 112. The second contact 238 is configured to be electrically connected to another conductor 126, which may be referred to hereinafter as a second conductor 242, of the circuit board 122 to define a second signal line of the mating connector 112. The first and second signal lines, defined by the first and second contacts 236, 238, transmit different data signals from the circuit board 122 to the textile connector 110 (shown in FIG. 2) via the mating connector 112. The circuit board 122 may include any number of conductors 126 and is not limited to the first and second conductors 240, 242. Such additional conductors 126 may be electrically connected to other mating connectors 112, or alternatively, the mating connector 112 may be electrically connected to additional conductors 126 in addition to the first and second conductors 240, 242.

The first snap segment 232 includes a flange 250 and a connecting segment 252 used to connect the first snap segment 232 to the second snap segment 234. In the illustrated embodiment, the connecting segment 252 is a socket configured for snap fastening to the textile connector 110. For example, the connecting segment 252 is a female part configured to receive the connecting segment 152 (shown in FIG. 2) of the textile connector 110. In alternative embodiments, the connecting segment 252 may be a stud and the connecting segment 152 may be a socket. Other types of connecting arrangements may be provided in alternative embodiments. In an exemplary embodiment, the connecting segment 252 is also used to connect the first snap segment 232 to the second snap segment 234.

The second snap segment 234 includes a flange 254 and a connecting segment 256. The connecting segment 256 of the second snap segment 234 is mechanically connected to the connecting segment 252 of the first snap segment 232. In the illustrated embodiment, the connecting segment 256 is a post or button configured to be received in the connecting segment 252. For example, the connecting segment 256 may pass through an opening 258 in the circuit board 122. The connecting segment 256 is plugged into the connecting segment 252. Other types of connecting arrangements may be provided in alternative embodiments. The connecting segment 256 may be sized and shaped to mechanically secure to the connecting segment 252. For example, the connecting segment 256 may be pressed into the connecting segment 252. The connecting segment 256 may be deformed when received into the connecting segment 252 to lock the second snap segment 234 to the first snap segment 232. When the first and snap segments are connected together, the circuit board 122 is positioned between the flanges 250, 254. The snap fastener 230 may be tightly held on the circuit board 122 when the snap segments 232, 234 are coupled together. Optionally, the material of the circuit board 122 may be at least partially compressed between the snap segments 232, 234.

In an exemplary embodiment, the flange 250 includes a first groove 260 and a second groove 262 extending circumferentially around the connecting segment 252. The first groove 260 receives the first contact 236 and the second groove 262 receives the second contact 238. Additional grooves may be provided in the flange 250 to hold additional contacts in various embodiments. The grooves 260, 262 hold the relative positions of the contacts 236, 238. The contacts 236, 238 may be held by the snap fastener 230 by mechanisms other than grooves in alternative embodiments.

In an exemplary embodiment, the first snap segment 232 is manufactured from a dielectric material such that the contacts 236, 238 are electrically isolated from each other by the dielectric material of the first snap segment 232. Optionally, the second snap segment 234 may be manufactured from a dielectric material similar to the dielectric material of the first snap segment 232. For example, the snap segments 232, 234 may be manufactured from a plastic material. Optionally, the second snap segment 234 may include grooves or slots configured to receive portions of the contacts 236, 238. In other various embodiments, the second snap segment 234 may include the grooves 260, 262 used to hold the first and second contacts 236, 238.

In an exemplary embodiment, the first and second contacts 236, 238 are ring shaped; however other types of contacts may be provided in alternative embodiments. The first and second contacts 236, 238 may include similar components and like components may be identified with like references numerals. The description below focuses the first contact 236, and the second contact 238 may include similar features.

The first contact 236 includes a main body 270. In the illustrated embodiment, the main body 270 is ring shaped and may be referred to herein after as a ring 270. The ring 270 of the first contact 236 has a first diameter 276 while the ring 270 of the second contact 238 has a second diameter 278 larger than the first diameter 276. The ring 270 of the first contact 236 thus defines an inner ring and the ring 270 of the second contact 238 thus defines an outer ring, which concentrically surrounds the inner ring of the first contact 236.

The first contact 236 includes one or more projections 272 that extend from the main body 270. The projections 272 may be spring beams that may be spring biased against corresponding conductors 126 of the circuit board 122. The projections 272 may be solder tails that may be soldered to corresponding conductors 126 of the circuit board 122. The projections 272 may be prongs or claws that may pierce the circuit board 122 and/or the conductors 126 to mechanically and electrically connect the first contact 236 to such conductor 126. Any number of projections 272 may extend from the main body 270. Optionally, the projections 272 may be spaced equally around the main body 270. Optionally, the first and second contacts 236, 238 may include a different number of projections 272.

During assembly, the contacts 236, 238 are loaded into the grooves 260, 262. Optionally, the first snap segment 232 may include openings 274 through the flange 250 that receive the projections 272. When the contacts 236, 238 are received in the grooves 260, 262, the projections 272 extend beyond the flange 250 (e.g. above the flange 250) for connection to the circuit board 122. The snap fastener 230 is position relative to the conductors 240, 242 such that at least one projection 272 of each contact 236, 238 engages the corresponding conductor 240, 242 to create an electrical connection therebetween.

In an exemplary embodiment, the contacts 236, 238 have a similar shape as the main bodies 170 of the contacts 136, 138 to define a large mating interface. Having the contacts 236, 238 (and the contacts 136, 138) ring-shaped eliminates the need for orienting the snap fastener 230 relative to the snap fastener 130. For example, the snap fastener 230 may have any rotational position relative to the snap fastener 130 and the contacts 236, 238 would be electrically connected to the contacts 136, 138. The connecting segments 252, 152 ensure alignment of the snap fasteners 230, 130 and the snap fastener 130 may be able to rotate relative to the snap fastener 230 while still maintaining electrical connection between the contacts 236, 136 and 238, 138. In alternative embodiments, the contacts 236, 238 and/or the contacts 136, 138 may have a non-ring shape. For example, the contacts 236, 238 may be pins, such as pogo-pins, terminated to the circuit board 122 and positioned at predetermined radial distances from the connecting segment 252 (e.g., the centerline of the snap fastener 230) to align with the corresponding contacts 136, 138. In the embodiment where the contacts 136, 138 are ring-shaped, the pogo-pins would still maintain electrical connection with the ring shaped main body irrespective of the rotational position of the snap fasteners 130, 230. However, in embodiments where the contacts 136, 138 are not ring shaped, but rather are pins or other shaped contacts, the snap fasteners 130, 230 may include alignment features, such as keying features, to ensure that the snap fasteners 130, 230 are at a predetermined position relative to each other such that the contacts 136, 236 and 138, 238 are aligned and mated.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. A textile connector comprising:

a snap fastener having first and second snap segments configured to be snap fastened together such that an electronic textile is mechanically secured therebetween with the first snap segment on one side of the electronic textile and the second snap segment on an opposite side of the electronic textile;

a first contact held by the snap fastener, the first contact configured to be electrically connected to a first conductor of the electronic textile to define a first signal line; and a second contact held by the snap fastener, the second contact configured to be electrically connected to a second conductor of the electronic textile to define a second signal line;

wherein the first and second signal lines transmit different data signals from the electronic textile to an electronic component mounted to the electronic textile.

2. The textile connector of claim 1, wherein the first contact is a ring having a first diameter and the second contact is a ring having a second diameter larger than the first diameter.

3. The textile connector of claim 1, wherein the first contact overlaps the first conductor at a first overlap region and is electrically connected thereto, the second contact overlaps the second conductor at a second overlap region and is electrically connected thereto.

4. The textile connector of claim 3, wherein the second contact overlaps the first conductor at a third overlap region and is electrically isolated therefrom by the snap fastener.

5. The textile connector of claim 1, wherein the first snap segment includes a first groove and a second groove, the first contact received in first groove, the second contact received in the second groove.

6. The textile connector of claim 1, wherein the first snap segment includes a connecting segment for connecting the snap fastener to the electronic component, the first and second contacts extending circumferentially around the connecting segment.

7. The textile connector of claim 1, wherein the first contact includes a main body and a projection extending therefrom, the main body being held by the first snap segment, the projection extending through the first snap segment to engage the first conductor.

8. The textile connector of claim 7, wherein the projection pierces the electronic textile at or near the first conductor to electrically engage the first conductor; the projection engaging the second snap segment such that the projection is sandwiched between the first and second snap segment.

9. The textile connector of claim 1, wherein the first snap segment includes a flange and a connecting segment, the flange including a first groove receiving the first contact and a second groove receiving the second contact; the second snap segment includes a flange and a connecting segment where the connecting segment of either the first or the second snap segment passes through the electronic textile to couple the first snap segment to the second snap segment such that the electronic textile is captured between the flanges of the first and second snap segments.

10. The textile connector of claim 9, wherein the first and second contacts include projections extending through the flange of the first snap segment to engage the first and second conductors, respectively, between the flanges of the first and second snap segments.

11. The textile connector of claim 1, wherein the first snap segment is manufactured from a dielectric material to electrically isolate the first contact from the second contact.

12. The textile connector of claim 1, wherein the snap fastener is configured to be snap-fastened to a snap fastener of a mating connector holding first and second mating contacts configured to be electrically connected to first and second conductors of the electronic component, the first contact being electrically connected to the first mating contact and the second contact being electrically connected to the second mating contact.

13. A textile connector comprising:

a snap fastener having first and second snap segments each having a connecting segment and a flange surrounding the connecting segment, the connecting segments configured to be snap fastened together with an electronic textile mechanically secured between the flanges of the first and second snap segments, the first snap segment having a first groove and a second groove, the flange of the first snap segment surrounding the first and second grooves being dielectric;

a first contact received in the first groove, the first contact configured to be electrically connected to a first conductor of the electronic textile to define a first signal line; and a second contact received in the second groove and electrically isolated from the first contact by the dielectric flange of the first snap segment, the second contact configured to be electrically connected to a second conductor of the electronic textile to define a second signal line;

wherein the first and second signal lines transmit different data signals from the electronic textile to an electronic component mounted to the electronic textile.

14. The textile connector of claim 13, wherein the first contact is a ring having a first diameter and the second contact is a ring having a second diameter larger than the first diameter.

15. The textile connector of claim 13, wherein the first contact overlaps the first conductor at a first overlap region and is electrically connected thereto, the second contact overlaps the second conductor at a second overlap region and is electrically connected thereto, and wherein the second contact overlaps the first conductor at a third overlap region and is electrically isolated therefrom by the dielectric flange of the first snap segment.

16. The textile connector of claim 13, wherein the first contact includes a main body and a projection extending therefrom, the main body being held by the first snap segment, the projection extending through the first snap segment to engage the first conductor.

17. The textile connector of claim 16, wherein the projection pierces the electronic textile at or near the first conductor to electrically engage the first conductor; the projection engaging the second snap segment such that the projection is sandwiched between the first and second snap segment.

18. A wearable electronic assembly comprising:

an electronic textile having textile material and first and second conductors interspersed with the textile material;

at least one electronic component mounted to the electronic textile; and a wearable textile connector electrically connecting the first and second conductors and the electronic connector, the textile connector comprising:

a snap fastener having first and second snap segments configured to be snap fastened together such that the electronic textile is mechanically secured therebetween with the first snap segment on one side of the electronic textile and the second snap segment on an opposite side of the electronic textile;

a first contact held by the snap fastener, the first contact configured to be electrically connected to the first conductor of the electronic textile to define a first signal line; and a second contact held by the snap fastener, the second contact configured to be electrically connected to the second conductor of the electronic textile to define a second signal line;

wherein the first and second signal lines transmit different data signals from the electronic textile to an electronic component mounted to the electronic textile.

19. The wearable electronic assembly of claim 18, wherein the electronic component includes a mating connector having a snap fastener holding first and second mating contacts terminated to a circuit board, the snap fastener of the textile connector configured to be snap fastened to the snap fastener of the mating connector such that the first contact is electrically connected to the first mating contact and the second contact is electrically connected to the second mating contact.

20. The wearable electronic assembly of claim 18, wherein the first contact includes a main body and a projection extending therefrom, the main body being held by the first snap segment, the projection extending through the first snap segment and piercing the electronic textile at or near the first conductor to electrically engage the first conductor.

* * * * *